US011857831B2

(12) United States Patent
Duffin

(10) Patent No.: US 11,857,831 B2
(45) **Date of Patent: *Jan. 2, 2024**

(54) MULTI-POSITION STRENGTH BAR

(71) Applicant: Elite Strength Equipment, LLC, Clackamas, OR (US)

(72) Inventor: Christopher Duffin, Clackamas, OR (US)

(73) Assignee: Elite Strength Equipment, LLC, Clackamas, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/837,012

(22) Filed: Jun. 9, 2022

(65) Prior Publication Data

US 2022/0296955 A1 Sep. 22, 2022

Related U.S. Application Data

(62) Division of application No. 16/381,885, filed on Apr. 11, 2019, now Pat. No. 11,554,285.

(60) Provisional application No. 62/656,830, filed on Apr. 12, 2018.

(51) Int. Cl.
*A63B 21/00* (2006.01)
*A63B 21/072* (2006.01)

(52) U.S. Cl.
CPC ..... *A63B 21/4005* (2015.10); *A63B 21/0004* (2013.01); *A63B 21/0724* (2013.01); *A63B 2244/09* (2013.01)

(58) Field of Classification Search
CPC ..... A63B 2225/09; A63B 2225/00; A63B 2244/09; A63B 21/0724; A63B 21/0004; A63B 21/4005; A63B 2023/003; A63B 23/1281; A63B 23/00
USPC ..... 482/106
See application file for complete search history.

(56) References Cited

U.S. PATENT DOCUMENTS 4,252,316 A * 2/1981 Price ..... A63B 21/0724 482/106
4,287,972 A * 9/1981 Petrak ..... F16D 43/206 192/54.2
4,625,846 A * 12/1986 Gomez ..... F16D 25/061 403/1
4,872,667 A * 10/1989 Favot ..... A63B 21/0724 482/106
4,903,962 A * 2/1990 Pollack ..... A63B 21/0724 482/106
5,116,297 A * 5/1992 Stonecipher ..... A63B 21/4035 482/137
5,342,272 A 8/1994 Pittroff
6,022,300 A * 2/2000 Hightower ..... A63B 21/0728 482/106
6,394,932 B1 5/2002 Chu
6,663,542 B1 * 12/2003 Trabbic ..... A63B 21/0724 482/106
6,875,161 B1 4/2005 Brice
(Continued)

*Primary Examiner* — Megan Anderson
(74) *Attorney, Agent, or Firm* — Chernoff, Vilhauer, McClung & Stenzel, LLP

(57) ABSTRACT

A lifting apparatus having a bar with a shoulder bar supportable on a lifter's shoulders and a weight sleeve configured to receive at least one weight. The lifting apparatus includes an adapter that allows adjustment of the distal member to one of a plurality of different positions relative to a longitudinal axis of the shoulder bar.

20 Claims, 3 Drawing Sheets

(56) References Cited

U.S. PATENT DOCUMENTS 8,033,964 B1* 10/2011 Chen ..... A63B 21/00069 482/106
8,047,975 B1* 11/2011 Chen ..... A63B 21/072 482/110
9,427,612 B1 8/2016 Swanson
10,500,433 B2 12/2019 Fairchild
10,589,143 B1* 3/2020 Smythe ..... A63B 21/4033
2003/0232704 A1* 12/2003 Bowman ..... A63B 21/0728 482/106
2004/0242385 A1* 12/2004 Emick ..... A63B 21/0783 482/106
2005/0250619 A1* 11/2005 Daikeler ..... A63B 1/00 482/40
2006/0105890 A1* 5/2006 Logue ..... A63B 21/0724 482/106
2011/0177922 A1 7/2011 Selinger
2011/0190098 A1 8/2011 Griswold et al.
2011/0251028 A1 10/2011 Bono
2012/0115684 A1 5/2012 Nguyen
2012/0195676 A1* 8/2012 Chung ..... B60B 39/12 403/1
2012/0196729 A1* 8/2012 Rafaeli ..... A63B 21/065 482/110
2013/0231225 A1 9/2013 Shozda
2014/0084117 A1 3/2014 Klonoski
2014/0087925 A1 3/2014 Dupuis
2014/0094347 A1* 4/2014 Orakwusi ..... A63B 23/1218 482/38
2014/0200119 A1 4/2014 Sides, Jr.
2014/0287889 A1* 9/2014 Grace ..... A63B 21/0783 482/106
2014/0302968 A1 10/2014 Velikin et al.
2016/0045777 A1 2/2016 Haggard et al.
2016/0074695 A1 3/2016 Lee
2016/0082304 A1 3/2016 Behle et al.
2016/0144221 A1* 5/2016 Wallander ..... A63B 21/4035 482/106
2016/0144230 A1* 5/2016 An ..... A63B 23/1218 482/40
2016/0354630 A1 12/2016 Kennedy
2017/0144011 A1* 5/2017 Gangemi ..... A63B 21/0552
2018/0021662 A1* 1/2018 Carpinelli ..... A63B 71/12 482/104
2018/0272176 A1* 9/2018 Aasa ..... A63B 21/062
2018/0296870 A1 10/2018 Gangemi et al.
2018/0296873 A1 10/2018 Amyan
2019/0046831 A1* 2/2019 Coury ..... A63B 21/4035

* cited by examiner

MULTI-POSITION STRENGTH BAR

CROSS REFERENCE TO RELATED APPLICATIONS

This application is a divisional of U.S. patent application Ser. No. 16/381,885 filed Apr. 11, 2022, which claims benefit of priority to U.S. Provisional Application Ser. No. 62/656,830 filed on Apr. 12, 2018.

BACKGROUND

The subject matter of this application relates to exercise equipment and more particularly to a weight-lifting apparatus.

Athletes, fitness enthusiasts, and others continuously seek new techniques to increase strength and performance. Many such persons engage in weight training to increase strength or otherwise improve muscular function, which may include the use of either free weights and/or weight machines. One problem experienced by those engaged in weight training is that a person can potentially strain their spine, leading to pain and discomfort. Although some degree of weight-bearing is essential for spinal health, too much weight on the spine during weight training can cause spinal discs to move or bulge, and furthermore, exercises that increase the axial load on the spine are especially prone to increase spine strain and back pain.

One type of lifting exercise prone to spinal strain or injury is a "squat" in which a lifter balances a weighted bar on the shoulders (either in back of or in front of the neck), bends the knees to a squatting position, and lifts the weighted bar back to a standing position. This particular exercise requires careful technique to avoid injuries since the forward-position of the weighted bar relative to the lifter's center of gravity as the person squats, creates stress, particularly on the shoulders and back.

What is desired, therefore, is an improved exercise apparatus for performing squats.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
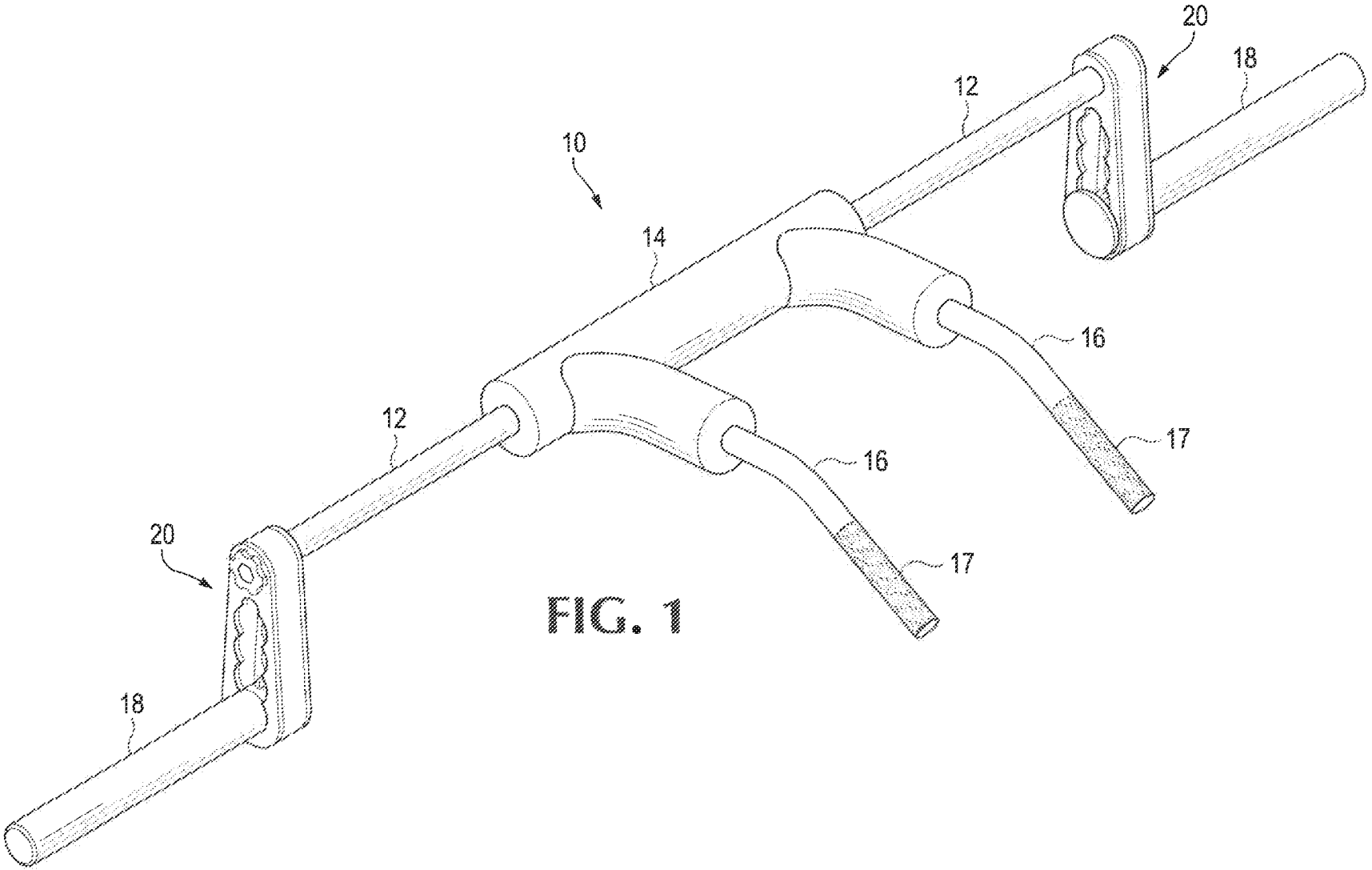
FIG. 1 shows an exemplary improved exercise bar having an adapter that interconnects a shoulder bar with a weight sleeve.

Referring to FIG. 1, an improved strength-training apparatus 10 may include an elongate shoulder bar 12 with a central support pad 14 from which two handles 16 project. In use, a lifter preferably places the support pad over the shoulders behind the lifter's neck, with the lifter's hands grasping the handles 16 firmly. In a preferred embodiment, the handles 16 may include a knurled or roughened surface 17 to prevent the lifter's grip from slipping when using the bar 12. Those of ordinary skill in the art will recognize that some embodiments of the bar 12 may not include the support pad 14 and/or the handles 16.

The strength training apparatus 10 includes, at each end, a respective weight sleeve 18 upon which a desired amount of weight may be loaded upon the strength-training apparatus 10. The weight sleeve 18 is preferably configured to be inserted into one or more Olympic-sized weights, which typically have central apertures of approximately two inches in diameter.

Figure 2:
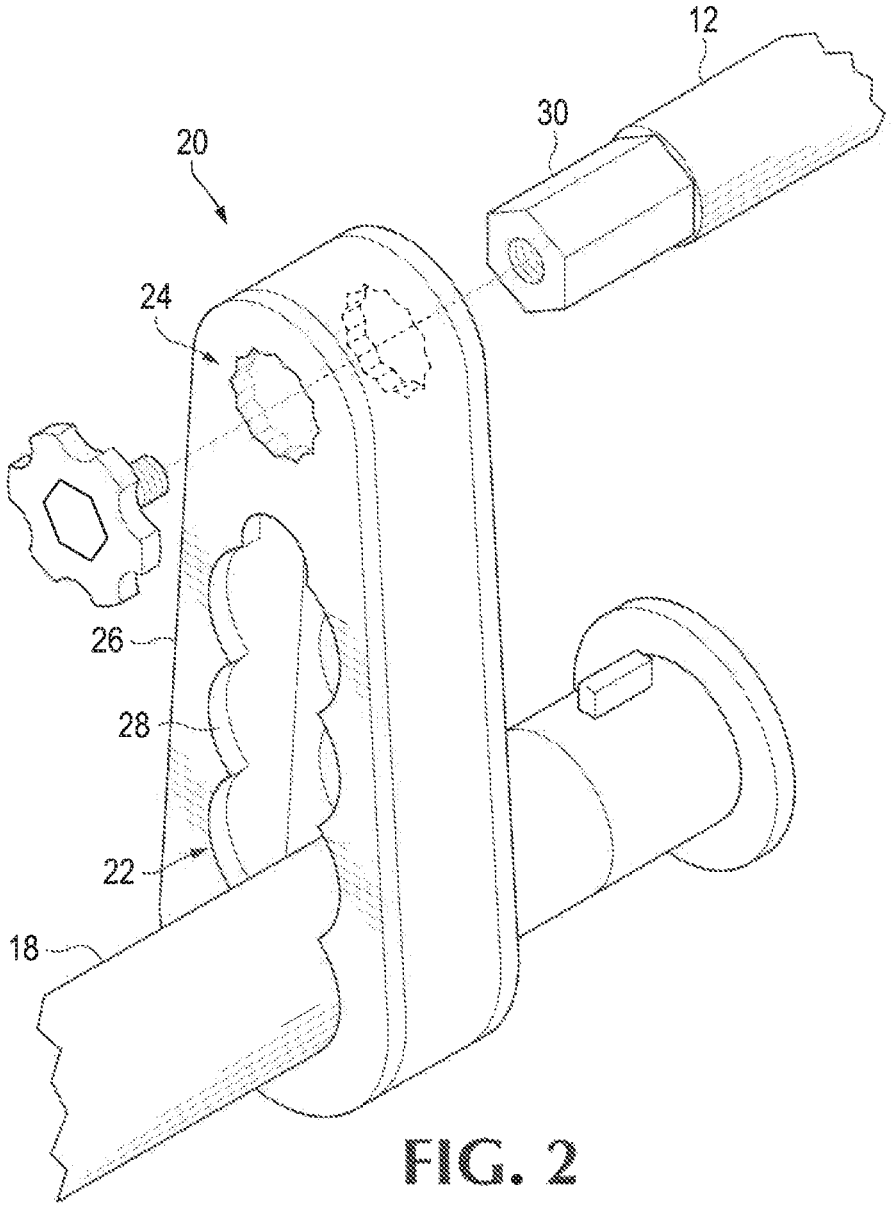
FIG. 2 shows a close-up view of the adapter of FIG. 1.

Referring also to FIG. 2, the weight sleeve 18 is laterally offset from the shoulder bar 12 by an adapter 20 having an angular adjustment interface 24 allowing rotation of the weight sleeve 18 about the longitudinal centerline of an inserted shoulder bar 12, and a radial adjustment interface 22 which allows the weight sleeve 18 to be adjusted in a radial direction relative to the axis of rotation of the angular adjustment interface 24. The combination of the radial adjustment interface 22 and the angular adjustment interface 24 allows a lifter to position the weights on the weight sleeve 18 in any one of a plurality of locations relative to the lifter's shoulders. In this manner, lifters can adjust the weights to a position that relieves stress while performing squats, or to simulate different types of squats (front, back, safety, etc.) with a single bar supported on the lifter's shoulders behind the neck.

In some embodiments, adjustment of either or both of the radial adjustment interface 22 and the angular adjustment interface 24 may allow continuous adjustment to any position desired throughout a range of adjustment. In other embodiments, the radial adjustment interface 22 and/or the angular adjustment interface 24 may allow incremental adjustment to one of a plurality of fixed positions within a range of adjustment. For example, as shown in FIG. 2 the radial adjuster 22 may be an elongate member 26 that defines a plurality of recesses 28 extending in an axial direction away from the axis of rotation of the angular adjustment interface 24, each of the plurality of recesses 28 capable of releasably and securely retaining a distal end of a weight sleeve 18. Preferably, each of the recesses 28 of the radial adjustment interface is sized to securely retain a weight sleeve configured to be inserted into an Olympic-sized weight. In some embodiments, such as the one shown in FIG. 2, the plurality of the recesses 28 form a contiguous slot. In such embodiments, the radial adjustment interface 22 may be configured to hold the weight sleeve 18 at a selective one of a plurality of axial positions approximately 1.5 inches from each other. Though FIG. 2 shows a radial adjuster with four such positions, other embodiments may include more or less such incremental positions.

Similarly, the angular adjustment interface 24 may in some embodiments have a plurality of fixed angular positions about which the adapter 20 may rotate. In a preferred embodiment, for example, the angular adjustment interface 24 includes an aperture formed by a periphery defining a plurality of notches, each notch configured to engage an edge of a polygonal-shaped distal end 30 of the shoulder bar 12, which in FIGS. 1 and 2 is shown as a hexagonal protrusion. Preferably, in this embodiment, the aperture includes sufficient notches to allow adjustment of the hexagonal end of the shoulder bar to at least six locations. As shown in FIG. 2, there are twelve notches, allowing adjustment to twelve independent angular orientations, though one of ordinary skill in the art will recognize that any desired number of orientations may be achieved. Preferably, the angular adjustment interface 24 includes an end cap having a threaded connection that may be matingly received in a bore within the weight bar 12 to secure the angular adjustment interface 24 in the desired position.

Figure 3:
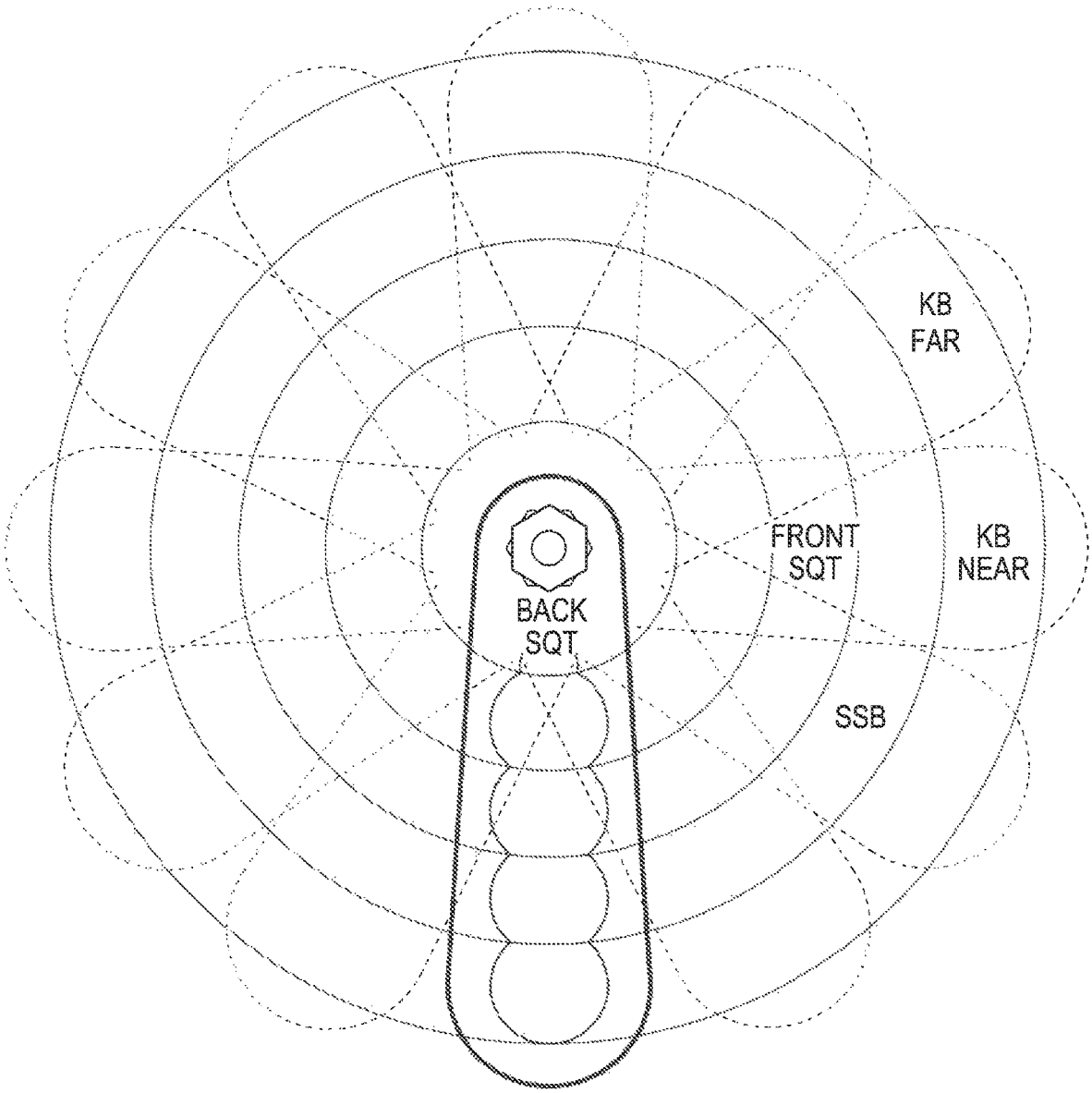
FIG. 3 shows a plurality of positions allowed by the adapter of FIG. 2.

As can be seen in FIG. 3, the combination of the radial adjustment interface 22 and the angular adjustment interface 24 allows a lifter to use the adapter 20 to position weights in any of a multitude of positions around the lifters body, extending 360-degrees around the weight bar 12 and many at different radial distances from the weight bar 12, thereby allowing a lifter position weights at an optimal location for spinal safety, while achieving a number of different types of squats, e.g. a front squat, a back squat, a safety squat etc. Those of ordinary skill in the art will appreciate however, that different adapters 20 may limit the angular or radial orientation of the adapter 20 relative to the weight bar 12 to a desired range less than 360 degrees.

It will be appreciated that the invention is not restricted to the particular embodiment that has been described, and that variations may be made therein without departing from the scope of the invention as defined in the appended claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

The invention claimed is:

1. An adapter for a weight lifting apparatus, the adapter comprising:

a first interface configured to retainably receive a distal end of a shoulder bar supportable on a person's shoulders, the first interface configured to selectively lock into a desired one of a plurality of radial positions about an axis of rotation of the adapter about the shoulder bar; and a second interface defining a plurality of recesses extending in a common axial direction away from the axis of rotation of the first interface, each of the plurality of recesses capable of releasably and securely retaining a distal end of a weight sleeve.

2. The adapter of claim 1 in combination with the shoulder bar and the weight sleeve.

3. The adapter of claim 2 where the first interface is configured to selectively lock into a desired one of the plurality of radial positions extending 360 degrees about the axis of rotation of the adapter.

4. The adapter of claim 3 where the plurality of radial positions includes at least six such radial positions.

5. The adapter of claim 4 where the plurality of radial positions includes at least twelve such radial positions.

6. The adapter of claim 2 where the shoulder bar includes a padded shoulder harness having opposed handles.

7. The adapter of claim 6 where the opposed handles are knurled.

8. The adapter of claim 2 where each of the plurality of recesses of the second interface is sized to securely retain a weight sleeve configured to be inserted into an Olympic-sized weight.

9. The adapter of claim 8 where the plurality of the recesses form a contiguous slot.

10. The adapter of claim 2 including an aperture formed by a periphery defining a plurality of notches, each notch configured to engage an edge of a polygonal-shaped distal end of said shoulder bar.

11. The adapter of claim 1 where the first interface is configured to selectively lock into a desired one of the plurality of radial positions extending 360 degrees about the axis of rotation of the adapter.

12. The adapter of claim 11 where the plurality of radial positions includes at least six such radial positions.

13. The adapter of claim 12 where the plurality of radial positions includes at least twelve such radial positions.

14. The adapter of claim 1 where each of the plurality of recesses of the second interface is sized to securely retain a weight sleeve configured to be inserted into an Olympic-sized weight.

15. The adapter of claim 14 where the plurality of the recesses form a contiguous slot.

16. The adapter of claim 1, where the first interface includes an aperture formed by a periphery defining a plurality of notches, each notch configured to engage an edge of a polygonal-shaped distal end of said shoulder bar.

17. A lifting apparatus comprising:

(a) a central member supportable on a lifter's shoulders and having a longitudinal axis;

(b) a distal member configured to pass through and securely retain at least one Olympic-sized weight; and (c) an adapter capable of selectively positioning the distal member to one of a plurality of different positions relative to the longitudinal axis, each of the plurality of different positions extending in a common axial direction away from the longitudinal axis.

18. The lifting apparatus of claim 17 where the adapter is configured to selectively lock into a desired one of a plurality of angular positions relative to the central member.

19. The lifting apparatus of claim 18 where the adapter includes an aperture formed by a periphery defining a plurality of notches, each notch configured to engage an edge of a polygonal-shaped distal end of the central member.

20. The lifting apparatus of claim 17 where the adapter includes a plurality of recesses, each respective recess at a respective one of the plurality of different positions.

* * * * *